US009038768B2

(12) United States Patent
Tsujino

(10) Patent No.: US 9,038,768 B2
(45) Date of Patent: May 26, 2015

(54) SOUND ABSORBING BODY AND PRINTING DEVICE

(71) Applicant: SEIKO EPSON CORPORATION, Tokyo (JP)

(72) Inventor: Kiyoshi Tsujino, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/177,419

(22) Filed: Feb. 11, 2014

(65) Prior Publication Data

US 2014/0224572 A1 Aug. 14, 2014

(30) Foreign Application Priority Data

Feb. 14, 2013 (JP) ..... 2013-026337

(51) Int. Cl.

| | |
|---|---|
| ***B41J 29/10*** | (2006.01) |
| ***E04B 1/84*** | (2006.01) |
| ***B41F 13/00*** | (2006.01) |
| ***B41F 16/00*** | (2006.01) |
| *B41J 29/00* | (2006.01) |
| *E04B 1/74* | (2006.01) |

(52) U.S. Cl.

CPC ..... *B41F 13/0024* (2013.01); *B41P 2213/44* (2013.01); *B41F 16/0006* (2013.01); *B41F 16/0053* (2013.01); *B41J 29/10* (2013.01)

(58) Field of Classification Search

USPC ..... 181/201, 200, 290, 286, 294

See application file for complete search history.

(56) References Cited

U.S. PATENT DOCUMENTS

| | | | | |
|---|---|---|---|---|
| 3,652,360 | A * | 3/1972 | Hartman et al. | 156/244.11 |
| 3,895,143 | A * | 7/1975 | Tarlow | 428/40.9 |
| 4,213,516 | A * | 7/1980 | Sulewsky | 181/286 |
| 4,214,646 | A * | 7/1980 | Planes et al. | 181/287 |
| 4,428,454 | A * | 1/1984 | Capaul et al. | 181/290 |
| 4,590,114 | A * | 5/1986 | Holtman | 428/171 |
| 4,828,932 | A * | 5/1989 | Morimoto et al. | 428/608 |
| 5,149,920 | A * | 9/1992 | Meeker et al. | 181/290 |
| 5,304,415 | A * | 4/1994 | Kurihara et al. | 428/328 |
| 5,684,278 | A * | 11/1997 | Yasukawa et al. | 181/286 |
| 5,834,711 | A * | 11/1998 | Haines | 181/290 |
| 5,965,851 | A * | 10/1999 | Herreman et al. | 181/200 |
| 6,789,646 | B2 * | 9/2004 | Wang et al. | 181/293 |
| 7,033,497 | B1 * | 4/2006 | Yamaguchi et al. | 210/315 |
| 7,070,848 | B2 * | 7/2006 | Campbell | 428/137 |
| 7,080,712 | B2 * | 7/2006 | Tsuiki et al. | 181/204 |
| 7,605,097 | B2 * | 10/2009 | Thompson et al. | 442/408 |
| 7,712,580 | B2 * | 5/2010 | Fuller et al. | 181/294 |
| 7,857,923 | B2 * | 12/2010 | Suda et al. | 156/62.2 |
| 8,051,950 | B2 * | 11/2011 | Alston | 181/294 |
| 8,118,177 | B2 * | 2/2012 | Drapela et al. | 210/504 |
| 8,256,572 | B2 * | 9/2012 | Castagnetti et al. | 181/290 |
| 8,496,088 | B2 * | 7/2013 | Kitchen et al. | 181/290 |
| 2004/0050619 | A1 * | 3/2004 | Bargo, II | 181/290 |
| 2011/0067348 | A1 * | 3/2011 | Giles et al. | 52/741.1 |

(Continued)

FOREIGN PATENT DOCUMENTS

JP 05-254214 A 10/1993

*Primary Examiner* — Edgardo San Martin

(74) *Attorney, Agent, or Firm* — Global IP Counselors, LLP

(57) ABSTRACT

A printing device includes a case, a printing unit arranged inside the case, and a sound absorbing body arranged inside the case. The sound absorbing body has parts with different densities including a dense part with a higher density and a non-dense part with a lower density. The non-dense part includes a fibrillated part that is fibrillated into fiber form, and an unfibrillated part that is not fibrillated into fiber form.

7 Claims, 4 Drawing Sheets

(56) References Cited

U.S. PATENT DOCUMENTS

2011/0226547 A1* 9/2011 Kuhl et al. ..... 181/294
2014/0124291 A1* 5/2014 Dugan et al. ..... 181/290
2014/0224571 A1* 8/2014 Tsujino ..... 181/201
2014/0224572 A1* 8/2014 Tsujino ..... 181/201
2014/0224573 A1* 8/2014 Tsujino ..... 181/202

* cited by examiner

SOUND ABSORBING BODY AND PRINTING DEVICE

CROSS-REFERENCE TO RELATED APPLICATIONS

This application claims priority to Japanese Patent Application No. 2013-026337 filed on Feb. 14, 2013. The entire disclosure of Japanese Patent Application No. 2013-026337 is hereby incorporated herein by reference.

BACKGROUND

1. Technical Field

The present invention relates to a sound absorbing body and a printing device.

2. Related Art

In the past, for example, with printers, items have been known for which a sound absorbing member for absorbing noise emanating from a printing head, platen and the like is equipped inside a case member (see Japanese Unexamined Patent Publication No. H05-254214, for example).

SUMMARY

However, since the density of the sound absorbing member noted above is almost uniform, it was necessary to make the thickness of the sound absorbing member even thicker to further increase the sound absorbing effect. Then, there was demand for a design that considered the thickness of the sound absorbing member when arranging the sound absorbing member inside an electronic device, and when the sound absorbing material became thicker, there was the problem that the external dimensions of electronic devices such as a printer and the like became larger.

The present invention was created to address at least a part of the problems described above, and can be realized as the modes or aspects below.

A printing device according to one aspect includes a case, a printing unit arranged inside the case, and a sound absorbing body arranged inside the case. The sound absorbing body has parts with different densities including a dense part with a higher density and a non-dense part with a lower density. The non-dense part includes a fibrillated part that is fibrillated into fiber form, and an unfibrillated part that is not fibrillated into fiber form.

With this constitution, when sound enters the sound absorbing body, it advances in the non-dense part and the dense part. When the density is uniform, sounds of certain frequencies attenuate (undergo sound absorption) easily, but with other frequencies, there are cases when attenuation is difficult. When there are areas with different densities such as with a non-dense part and a dense part, the easily attenuated frequencies differ for these respectively, so it is possible to attenuate sounds (do sound absorption) of various frequencies. Furthermore, the non-dense part includes a fibrillated part and an unfibrillated part. Because of this, sound passes through the fibrillated part while being reflected by the unfibrillated part with the non-dense part as well, so it is possible to lengthen the distance the sound passes through, and to further increase the sound absorbing effect. Also, with a sound absorbing body of the same thickness, it is possible to obtain a greater sound absorbing effect by including the unfibrillated part and the fibrillated part, so it is possible to reduce the thickness of the sound absorbing body. Then, the noise generated by the printing unit undergoes sound absorption by the sound absorbing body, so it is possible to provide a printing device with excellent sound absorbing properties. Also, the arranged sound absorbing body has high sound absorbing efficiency, so it is possible to inhibit the thickness of the sound absorbing body itself. By doing this, it is possible to make the printing device compact. In addition to printing devices, it is also possible to apply this to various types of electronic devices that require sound absorption.

With the printing device of the aspect noted above, the single sound absorbing body preferably has the dense part and the non-dense part.

With this embodiment, with the single sound absorbing body, the dense part and the non-dense part are formed as an integrated unit. By doing this, for example, compared to a constitution for which layers having a dense part and layers having a non-dense part are formed separately and respectively overlapped, it is unnecessary to manage the adhesive properties between each layer, making handling easy.

With the printing device of the aspect noted above, the density of the single sound absorbing body preferably gradually changes from the dense part toward the non-dense part.

With this constitution, the density gradually changes, so compared to an item for which there is a density change point (boundary line), the sound absorption characteristics do not change suddenly. Therefore, there is no loss of sound absorption characteristics.

With the printing device of the aspect noted above, the dense part preferably includes a plurality of dense layers and the non-dense part preferably includes a plurality of non-dense layers with the dense layers and the non-dense layers being alternately laminated, and the density of the dense layers preferably gradually increases along a laminated direction.

With this constitution, there are non-dense layers between the dense layers laminated so as to have the density gradually increase. By doing this, for example when sound penetrates from a low density layer, it is possible to do sound absorption gradually.

A sound absorbing body according to another aspect includes parts of different densities including a dense part with a higher density, and a non-dense part with a lower density. The non-dense part including a fibrillated part that is fibrillated into fiber form, and an unfibrillated part that is not fibrillated into fiber form.

With this constitution, when sound enters the sound absorbing body, it advances in the non-dense part and the dense part. When the density is uniform, sounds of certain frequencies attenuate (undergo sound absorption) easily, but with other frequencies, there are cases when attenuation is difficult. When there are areas with different densities such as with a non-dense part and a dense part, the easily attenuated frequencies differ for these respectively, so it is possible to attenuate sounds (do sound absorption) of various frequencies. Furthermore, the non-dense part includes a fibrillated part and an unfibrillated part. Because of this, sound passes through the fibrillated part while being reflected by the unfibrillated part with the non-dense part as well, so it is possible to lengthen the distance the sound passes through, and to further increase the sound absorbing effect. Also, with a sound absorbing body of the same thickness, it is possible to obtain a greater sound absorbing effect by including the unfibrillated part and the fibrillated part, so it is possible to reduce the thickness of the sound absorbing body.

BRIEF DESCRIPTION OF THE DRAWINGS

Referring now to the attached drawings which form a part of this original disclosure.

DETAILED DESCRIPTION OF EXEMPLARY EMBODIMENTS

Figure 1A:
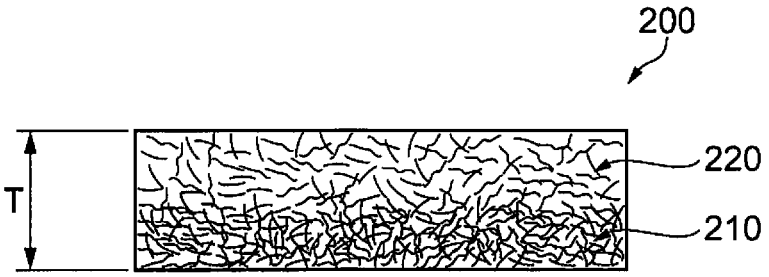
FIGS. 1A and 1B are pattern diagrams showing the constitution of a sound absorbing body of a first embodiment.

Following, we will describe a first and second embodiment of the present invention while referring to the drawings. In each drawing hereafter, to make each component and the like be a size of a level that is recognizable, the scale of each component and the like is shown different from actuality.

First Embodiment

First, we will describe the constitution of the sound absorbing body. The sound absorbing body is an item that absorbs noise (does sound absorption) for electronic devices and the like, for example. Then, the sound absorbing body has a dense part with a higher density, and a non-dense part with a lower density, and the non-dense part includes a fibrillated part that is fibrillated into fiber form, and an unfibrillated part that is not fibrillated into fiber form.

Figure 1B:
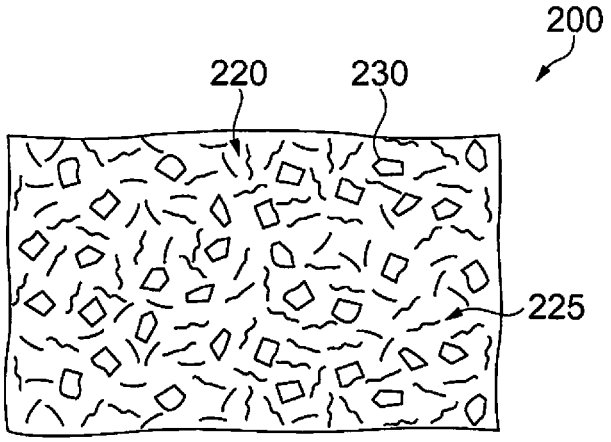

FIGS. 1A and 1B show the constitution of the sound absorbing body of the first embodiment, and FIG. 1A is a pattern diagram showing the constitution of the sound absorbing body. Specifically, it is a pattern diagram of when observing a plane 201 of a rectangular solid sound absorbing body 200. As shown in FIG. 1A, the sound absorbing body 200 has a dense part 210 with high density and a non-dense part 220 with a lower density than the dense part 210. The sound absorbing body 200 has a dense part 210 and a non-dense part 220 for one (one unit) constitution. Then, with one sound absorbing body 200, the density gradually changes from the dense part 210 toward the non-dense part 220. With this embodiment, at the one surface side and other surface side in the thickness direction T of the rectangular solid shaped sound absorbing body 200, there is a dense part 210 and a non-dense part 220.

The sound absorbing body 200 is suitable as an item for absorbing noise, and for example is an item incorporated inside the case of a printing device and the like. Then, with this embodiment, in a state with one sound absorbing body 200 not incorporated inside the case of the printing device, there is a non-dense density part 220 and a dense part 210. Then, in a state not incorporated inside the case of the printing device, said another way, in a state without being deformed by doing something like compressing the sound absorbing body 200 and the like, the thickness of the sound absorbing body 200 is formed to be constant.

FIG. 1B is an enlarged view of the non-dense part. The non-dense part 220 of the sound absorbing body 200 of this embodiment includes a fibrillated part 225 for which the pulp material is fibrillated and an unfibrillated part 230 for which the pulp material is not fibrillated. The unfibrillated part 230 is paper pieces of approximately 2 to 4 mm square (or diameter), for example. Also, the unfibrillated part 230 is a part that has higher density than the fibrillated part 225. Then, when sound enters the sound absorbing body 200 from the non-dense part 220 side, it advances to the dense part 210 from the non-dense part 220. It advances in the gradually changing density part, so it is possible to attenuate sounds (do sound absorption) of various frequencies. Furthermore, the non-dense part 220 includes the fibrillated part 225 and the unfibrillated part 230. Because of that, sound passes through the fibrillated part 225 while being reflected by the unfibrillated part 230 in the non-dense part as well, so it is possible to obtain a higher sound absorbing effect.

The sound absorbing body 200 is an item formed from a mixture including cellulose fiber, molten resin, and flame retardant. The cellulose fiber is an item for which a pulp sheet and the like is fibrillated using a dry type defibrillating machine such as a rotary crushing device, for example. Then, mixed in with this fibrillated fiber group is the unfibrillated part that has not been fibrillated (e.g. paper pieces).

The molten resin is an item that binds between cellulose fibers, gives suitable strength (hardness and the like) to the sound absorbing body 200, prevents paper powder and fiber from scattering, and contributes to maintaining the shape of the sound absorbing body 200. For the molten resin, it is possible to use various modes such as fiber form, powder form and the like. Then, by heating the mixture with cellulose fiber and molten resin mixed, it is possible to melt the molten resin, and to fuse the cellulose fibers and harden them. It is preferable to fuse at a temperature of a level that will not cause thermal degradation of the cellulose fibers and the like. Also, it is preferable that the molten resin be in a fiber form that easily entwines with paper fibers in the fibrillated material. Furthermore, it is preferable to use a core-sheath structure conjugated fiber. With the core-sheath structure molten resin, the surrounding sheath part melts at a low temperature, and by the fiber form core part bonding with the molten resin itself or with the cellulose fiber, it is possible to make a strong bond.

The flame retardant is an item added to give flame resistance to the sound absorbing body 200. As the flame retardant, for example, it is possible to use inorganic materials such as aluminum hydroxide, magnesium hydroxide and the like, or phosphorous based organic materials (e.g. aromatic phosphate such as triphenylphosphate and the like).

As the sound absorbing body 200 forming method, for example, a mixture for which cellulose fiber, molten resin, and flame retardant are mixed are placed in a sieve, and this is deposited so as to form a designated shape on a mesh belt arranged beneath the sieve to form a deposit. Then, the formed deposited substance undergoes pressurization heat treatment. By doing this, the molten resin is melted, and this is formed to a desired thickness. Furthermore, by die cutting to a desired dimension, the sound absorbing body 200 is formed.

Then, for example when the sound absorbing body density is uniform, sounds of certain frequencies attenuate (undergo sound absorption) easily, but with other frequencies, there are cases when attenuation is difficult. When there are areas with different densities such as with a non-dense part and a dense part, the easily attenuated frequencies differ for these respectively, so it is possible to attenuate sounds (do sound absorption) of various frequencies. Furthermore, the non-dense part 220 includes a fibrillated part and an unfibrillated part. Because of this, sound passes through the fibrillated part while being reflected by the unfibrillated part with the non-dense part 220 as well, so it is possible to further increase the sound absorbing effect.

Second Embodiment

Next, we will describe the second embodiment.

Figure 2A:
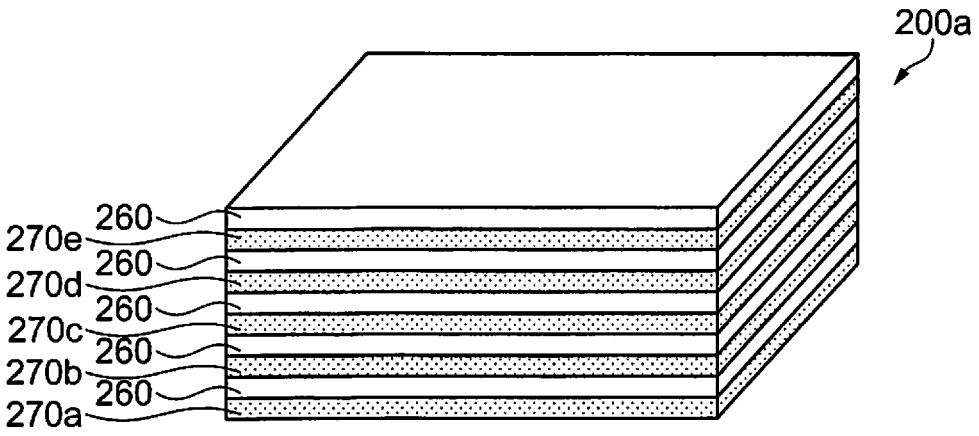
FIGS. 2A and 2B are pattern diagrams showing the constitution of a sound absorbing body of a second embodiment.
Figure 2B:
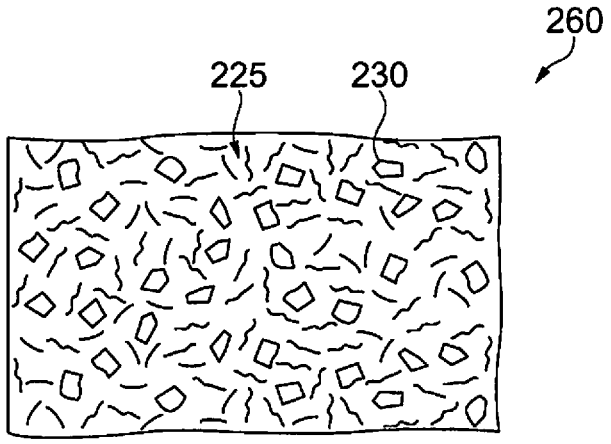

First, we will describe the constitution of the sound absorbing body. FIGS. 2A and 2B are pattern diagrams showing the constitution of the sound absorbing body, FIG. 2A is a schematic outline drawing, and FIG. 2B is an enlarged view of the non-dense part. The sound absorbing body 200*a* is for example an item for absorbing noise (doing sound absorption) for a printing device and the like. As shown in FIG. 2A and FIG. 2B, with one sound absorbing body 200*a*, there are dense density parts 270*a* to 270*e* (dense layers) and non-dense parts 260 (non-dense layers) having lower density than the dense parts 270*a* to 270*e*, and the non-dense parts 260 include the fibrillated part 225 for which the pulp material is fibrillated, and the unfibrillated part 230 for which the pulp material is not fibrillated. The unfibrillated part 230 is paper pieces of approximately 2 to 4 mm square (or diameter), for example. Also, the unfibrillated part 230 is a part that has higher density than the fibrillated part 225.

Also, as shown in FIG. 2A, with the sound absorbing body 200*a*, the dense parts 270*a* to 270*e* and the non-dense parts 260 are alternately laminated. With this embodiment, five dense parts 270*a* to 270*e* and similarly five non-dense parts 260 are respectively alternately laminated. In specific terms, the non-dense part 260 is laminated on top of the dense part 270*a*, the dense part 270*b* is laminated on top of that non-dense part 260, the non-dense part 260 is laminated on top of the dense part 270*b*, the dense part 270*c* is laminated on top of that non-dense part 260, the non-dense part 260 is laminated on top of the dense part 270*c*, the dense part 270*d* is laminated on top of that non-dense part 260, the non-dense part 260 is laminated on top of the dense part 270*d*, the dense part 270*e* is laminated on top of that non-dense part 260, and the non-dense part 260 is laminated on top of the dense part 270*e*. With this embodiment, five dense parts 270*a* to 270*e* and five non-dense parts 260 were alternately laminated, but the lamination count is not particularly restricted.

Then, with the sound absorbing body 200*a* of this embodiment, the constitution is such that the density gradually changes facing the lamination direction with the plurality of laminated dense parts 270*a* to 270*e*. In more detail, the constitution is such that the density gradually increases facing from the dense part 270*e* laminated on the top toward the dense part 270*a* laminated on the bottom. The density is stipulated from at least one of the cellulose fibers, the molten resin, and the flame retardant included in the sound absorbing body 200*a*.

Because of this, when sound enters the sound absorbing body 200*a*, it advances through the non-dense parts 260 and the dense parts 270*a* to 270*e*, so it is possible to attenuate sounds of various frequencies (do sound absorption). Furthermore, the non-dense part 260 includes the fibrillated part 225 and the unfibrillated part 230. Because of this, the sound passes through the fibrillated part 225 while being reflected by the unfibrillated part 230 with the non-dense part 260 as well, so it is possible to further increase the sound absorbing effect. With this embodiment, of the laminated dense parts 270*a* to 270*e*, it is preferable that the sound enter from the dense part 270*e* having the lowest density. Because the dense part 270*e* has the lowest density among the laminated dense parts 270*a* to 270*e*, the reflection of the entered sound is reduced, and it is possible to have sound enter inside the sound absorbing body 200*a* efficiently.

The sound absorbing body 200*a* is an item formed from a mixture including cellulose fiber, molten resin, and flame retardant. The cellulose fiber is an item for which a pulp sheet and the like is fibrillated using a dry type defibrillating machine such as a rotary crushing device, for example. Then, mixed in with this fibrillated fiber group is the unfibrillated part that has not been fibrillated (e.g. paper pieces).

The molten resin is an item that binds between cellulose fibers, gives suitable strength (hardness and the like) to the sound absorbing body 200*a*, prevents paper powder and fiber from scattering, and contributes to maintaining the shape of the sound absorbing body 200*a*. For the molten resin, it is possible to use various modes such as fiber form, powder form and the like. Then, by heating the mixture with cellulose fiber and molten resin mixed, it is possible to melt the molten resin, and to fuse the cellulose fibers and harden them. It is preferable to fuse at a temperature of a level that will not cause thermal degradation of the cellulose fibers and the like. Also, it is preferable that the molten resin be in a fiber form that easily entwines with paper fibers in the fibrillated material. Furthermore, it is preferable to use a core-sheath structure conjugated fiber. With the core-sheath structure molten resin, the surrounding sheath part melts at a low temperature, and by the fiber form core part bonding with the molten resin itself or with the cellulose fiber, it is possible to make a strong bond.

The flame retardant is an item added to give flame resistance to the sound absorbing body 200*a*. As the flame retardant, for example, it is possible to use inorganic materials such as aluminum hydroxide, magnesium hydroxide and the like, or phosphorous based organic materials (e.g. aromatic phosphate such as triphenylphosphate and the like).

As the sound absorbing body 200*a* forming method, for example, a mixture for which cellulose fiber, molten resin, and flame retardant are mixed are placed in a sieve, and this is deposited so as to form a designated shape on a mesh belt arranged beneath the sieve to form a deposit. Then, the formed deposited substance undergoes pressurization heat treatment. By doing this, the molten resin is melted, and this is formed to a desired thickness. Furthermore, by die cutting to a desired dimension, the sound absorbing body 200*a* is formed.

Figure 3:
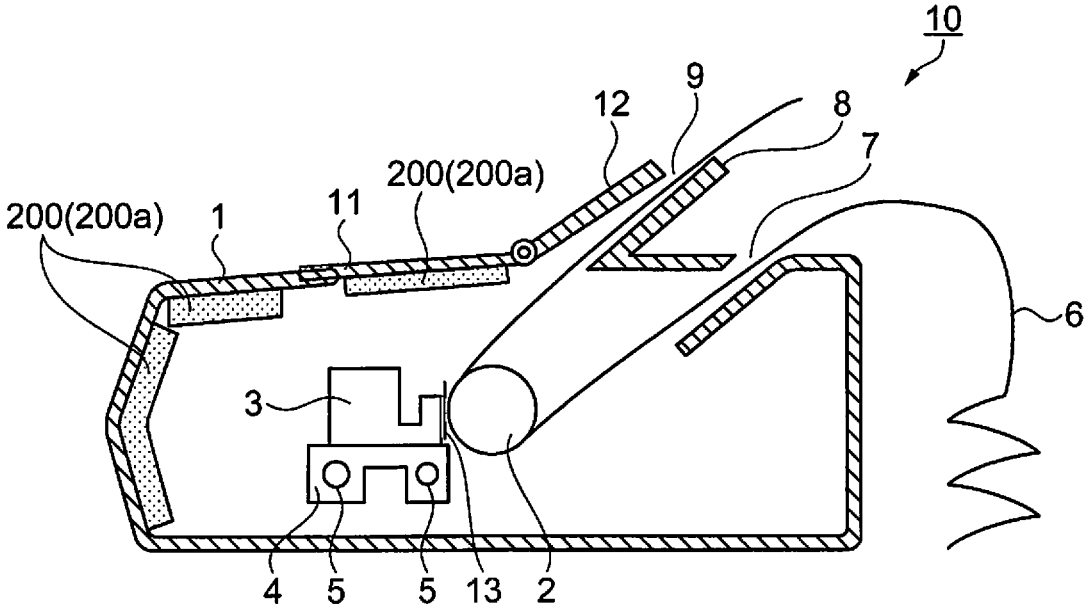
FIG. 3 is a schematic diagram showing the constitution of the printer.

Next, we will describe the constitution of the printing device. With this embodiment, we will describe the constitution of a printer as the printing device. FIG. 3 is a cross section diagram showing the constitution of the printer. As shown in FIG. 3, the printer 10 of this embodiment is equipped with a case 1, a printing head 3 as the printing unit arranged inside the case 1, a sound absorbing body 200 (200*a*) arranged inside the case 1 and the like. This printer 10 performs printing by giving an impact using a printing wire (not illustrated) provided inside the printing head 3 via an ink ribbon 13 on printing paper 6 as a printing medium arranged between a platen 2 and the printing head 3.

The printing paper 6 is fed from the paper feeding port 7 provided in the case 1 of the printer 10 and wound on the platen 2, printing is performed by the printing head 3 (in addition to numbers, letters and the like, this is a broad concept also including printing graphs using dots and the like), and the paper is ejected from a paper ejection port 9. A carriage 4 can be guided by a guide shaft 5 and moved in the axial direction. The ink ribbon 13 is interposed between the printing head 3 and the printing paper 6, and the printing head 3 fixed to the carriage 4 performs printing by driving a plurality of printing wires provided inside the printing head 3 at a desired timing while moving in the axial direction.

A freely openable/closable cover 11 and a paper ejection port cover 12 are attached to the case 1, and the paper ejection port cover 12 is rotatably connected to the cover 11. Also, the paper ejection port cover 12 is constituted with a transparent, light member, so the printing paper 6 is easy to see, and it is easy to take it out. Then, the printed printing paper 6 is ejected from the paper ejection port 9 along a paper guide 8.

Also, the printer 10 is equipped with the sound absorbing body 200 (200*a*) that absorbs noise (does sound absorption).

The constitution of the sound absorbing body 200 (200*a*) is the same as the constitution in FIGS. 1A and 1B (FIGS. 2A and 2B), so we will omit a description. With this embodiment, the sound absorbing body 200 (200*a*) is arranged at the part corresponding to the periphery of the printing head 3 of the case 1. In specific terms, it is arranged at the part corresponding to the side opposite to the drive part of the printing head 3 of the case 1. Furthermore, the sound absorbing body 200 (200*a*) is also arranged on the cover 11 corresponding to above the printing head 3. By doing this, the noise generated with the driving of the printing head 3 effectively undergoes sound absorption, and it is possible to prevent the diffusion of noise inside the case 1.

Also, when installing the sound absorbing body 200 or 200*a* on a case 1 or cover 11, the arrangement is done such that the non-dense parts 220 and 260 with the sound absorbing body 200 or 200*a* appears on the surface, specifically so that the non-dense parts 220 and 260 face opposite the printing head 3. By working in this way, it is possible to make it easier to have the sound generated from the printing head 3 absorbed more easily. In particular, with installation of the sound absorbing body 200*a*, the installation is done such that the dense part 270*a* of the sound absorbing body 200*a* is arranged on the surface side of the case 1. Also, doing the same in the case of installing the sound absorbing body 200*a* on the cover 11, the installation is done such that the dense part 270*a* of the sound absorbing body 200*a* is arranged on the surface side of the cover 11. By working in this way, the dense part 270*e* has the lowest density among the dense parts 270*a* to 270*e*, so the reflection of the entering sound is decreased, and it is possible for the sound to enter inside the sound absorbing body 200*a* efficiently, and also possible to decrease diffusion of sound in the internal space of the case 1.

With this embodiment, we described an example of a printer as the printing device, but the invention is not limited to this, and it is also possible to apply this to various types of electronic devices.

As described above, with this embodiment, the following effects can be obtained.

(1) With the sound absorbing body 200, sound can be absorbed by advancing in the dense part 210 and the non-dense part 230. Furthermore, the non-dense part 220 includes the fibrillated part 225 and the unfibrillated part 230, so sound is reflected by the unfibrillated part 230 even with the non-dense part 220, and by the reflected sound advancing in the fibrillated part 225, it is possible to increase the sound absorption effect.

(2) With the sound absorbing body 200*a*, when the sound enters the sound absorbing body 200*a*, it advances in the dense parts 270*a* to 270*e* and the non-dense parts 260, so it is possible to attenuate the sound (do sound absorption). Furthermore, the non-dense part 260 includes the fibrillated part 225 and the unfibrillated part 230. Because of this, the sound passes through the fibrillated part 225 while being reflected by the unfibrillated part 230 with the non-dense part 260 as well, so it is possible to further increase the sound absorption effect.

(3) With the printer 10 equipped with the sound absorbing body 200 and 200*a* noted above, it is possible to efficiently reduce noise during driving of the printing head 3.

EXAMPLE

Next, we will describe specific examples of the present invention.

1. Mixture

(1) Cellulose Fiber

A pulp sheet cut into several cm using a cutting machine was fibrillated into floc using a turbo mill (made by Turbo Kogyo Co., Ltd.).

(2) Molten Resin

This is polyethylene having a core-sheath structure, with the sheath melted at 100° C. or greater, and the core being 1.7 dtex molten fiber consisting of polyester (Tetoron, made by Teijin, Ltd.).

(3) Flame Retardant

Aluminum hydroxide B53 (made by Nippon Light Metal Co., Ltd.)

2. Formation of the Sound Absorbing Body

Example 1

Formation of the Sound Absorbing Body A

A mixture C1 for which 100 weight parts of cellulose fiber, 25 weight parts of molten fiber (fiber length 3 mm), and 10 weight parts of flame retardant were air mixed was formed. Also, a mixture C2 for which 100 weight parts of cellulose fiber, 15 weight parts of molten fiber (fiber length 5 mm), and 10 weight parts of flame retardant were air mixed was formed. Then, without using a suction device, this was deposited on a mesh belt. First, the mixture C1 was passed through a 10 mm opening sieve and allowed to fall freely, and was deposited by its own weight on the mesh belt. After that, the mixture C2 was passed through a 10 mm opening sieve facing the deposited mixture C1 and allowed to fall freely, and the mixture C2 was deposited by its own weight on the mixture C1. Then, the deposited deposit substance underwent pressurization heat treatment at 200° C. After that, this was cut to ϕ29 mm and 10 mm thick to form sound absorbing body A. When the density of that sound absorbing body A was measured, rather than the density being even at one surface side and the other surface side in the thickness direction, a dense part with high density and a non-dense part with lower density than the dense part were formed. In specific terms, the density of the bottom layer side corresponding to the one surface side deposited on the mesh belt side was higher than the density of the top layer side corresponding to the other surface side. Furthermore, the non-dense part includes the fibrillated part fibrillated into fiber form and the unfibrillated part not fibrillated into fiber form.

Comparison Example 1

Formation of the Sound Absorbing Body R1

A mixture C1 for which 100 weight parts of cellulose fiber, 25 weight parts of molten fiber (fiber length 3 mm), and 10 weight parts of flame retardant were air mixed was formed. Also, a mixture C2 for which 100 weight parts of cellulose fiber, 15 weight parts of molten fiber (fiber length 5 mm), and 10 weight parts of flame retardant were air mixed was formed. Then, without using a suction device, this was deposited on a mesh belt. First, the mixture C1 was passed through a 3 mm opening sieve and allowed to fall freely, and was deposited by its own weight on the mesh belt. After that, the mixture C2 was passed through a 3 mm opening sieve facing the deposited mixture C1 and allowed to fall freely, and the mixture C2 was deposited by its own weight on the mixture C1. Then, the deposited deposit substance underwent pressurization heat treatment at 200° C. After that, this was cut to ϕ29 mm and 10 mm thick to form sound absorbing body A. When the density of that sound absorbing body A was measured, rather than the density being even at one surface side and the other surface side in the thickness direction, a dense part with high density and a non-dense part with lower density than the dense part were formed. In specific terms, the density of the bottom layer side corresponding to the one surface side deposited on the mesh belt side was higher than the density of the top layer side corresponding to the other surface side. However, the non-dense part and the dense part do not include the unfibrillated part. This is because during forming of the mixture, since the sieve opening size (3 mm) was fine, it did not fall from the sieve.

Example 2

Formation of the Sound Absorbing Body B a: Formation of the Mixture C3

A mixture C3' for which 100 weight parts of cellulose fiber, 25 weight parts of molten fiber, and 10 weight parts of flame retardant were air mixed was passed through a 3 mm opening size sieve, and a mixture C3 that passed through that sieve was formed.

b: Formation of the Mixture C4

A mixture C4' for which 100 weight parts of cellulose fiber, 23 weight parts of molten fiber, and 10 weight parts of flame retardant were air mixed was passed through a 3 mm opening size sieve, and a mixture C4 that passed through that sieve was formed.

c: Formation of the Mixture C5

A mixture C5' for which 100 weight parts of cellulose fiber, 21 weight parts of molten fiber, and 10 weight parts of flame retardant were air mixed was passed through a 3 mm opening size sieve, and a mixture C5 that passed through that sieve was formed.

d: Formation of the Mixture C6

A mixture C6' for which 100 weight parts of cellulose fiber, 19 weight parts of molten fiber, and 10 weight parts of flame retardant were air mixed was passed through a 3 mm opening size sieve, and a mixture C6 that passed through that sieve was formed.

e: Formation of the Mixture C7

A mixture C7' for which 100 weight parts of cellulose fiber, 17 weight parts of molten fiber, and 10 weight parts of flame retardant were air mixed was passed through a 3 mm opening size sieve, and a mixture C7 that passed through that sieve was formed.

f: Formation of the Mixture C8

A mixture C8' for which 100 weight parts of cellulose fiber, 15 weight parts of molten fiber, and 10 weight parts of flame retardant were air mixed was passed through a 3 mm opening size sieve, and a mixture C8 that passed through that sieve was formed.

g: Formation of the Mixture C9

A mixture C9' for which 100 weight parts of cellulose fiber, 15 weight parts of molten fiber, and 10 weight parts of flame retardant were air mixed was passed through a 10 mm opening size sieve, and a mixture C9 that passed through that sieve was formed.

Subsequently, using the mixtures C3 to C9 noted above, the sound absorbing body B is formed. First, the mixture C3 was deposited on the mesh belt MB. Next, the mixture C9 was deposited on the deposited mixture C3. Next, the mixture C4 was deposited on the deposited mixture C9. Next, the mixture C9 was deposited on the deposited mixture C4. Next, the mixture C5 was deposited on the deposited mixture C9. Next, the mixture C9 was deposited on the deposited mixture C5. Next, the mixture C6 was deposited on the deposited mixture C9. Next, the mixture C9 was deposited on the deposited mixture C6. Next, the mixture C7 was deposited on the deposited mixture C9. Next, the mixture C9 was deposited on the deposited mixture C7. Next, the mixture C8 was deposited on the deposited mixture C9. Next, the mixture C9 was deposited on the deposited mixture C8. Then, the deposited material underwent pressurization heat treatment at 200° C. After that, this was cut to ϕ29 mm and 10 mm thick to form sound absorbing body B. With the sound absorbing body B, the dense parts and the non-dense parts were alternately laminated. Also, with the dense part, the density gradually increased from the top layer toward the bottom layer. Also, the non-dense part had a fibrillated part and an unfibrillated part formed on it, but the dense part did not have the unfibrillated part formed on it. This is because the sieve opening size differs during formation of the mixtures, and the sieve opening dimensions (3 mm) corresponding to the mixtures C1 to C6 are smaller (finer) than the sieve opening dimension (10 mm) corresponding to the mixture C7.

Comparison Example 2

Formation of the Sound Absorbing Body R2

First, the mixture C3 was deposited on the mesh belt MB. Next, the mixture C4 was deposited on the deposited mixture C3. Next, the mixture C5 was deposited on the deposited mixture C4. Next, the mixture C6 was deposited on the deposited mixture C5. Next, the mixture C7 was deposited on the deposited mixture C6. Next, the mixture C8 was deposited on the deposited mixture C7. Then, that deposited material underwent pressurization heat treatment at 200° C. After that, this was cut to ϕ29 mm and 10 mm thick to form sound absorbing body R2. With that sound absorbing body R2, the dense part density gradient was confirmed.

3. Evaluation

Next, an evaluation of the sound absorbing properties is performed for the example 1, the example 2, and the comparison examples 1 and 2 noted above. This sound absorbing property evaluation measures the sound absorption rate (normal incident sound absorption rate) based on JIS A 1405-2. Specific details are as noted below.

(a) Sound Absorption Property Evaluation Method

Figure 4:
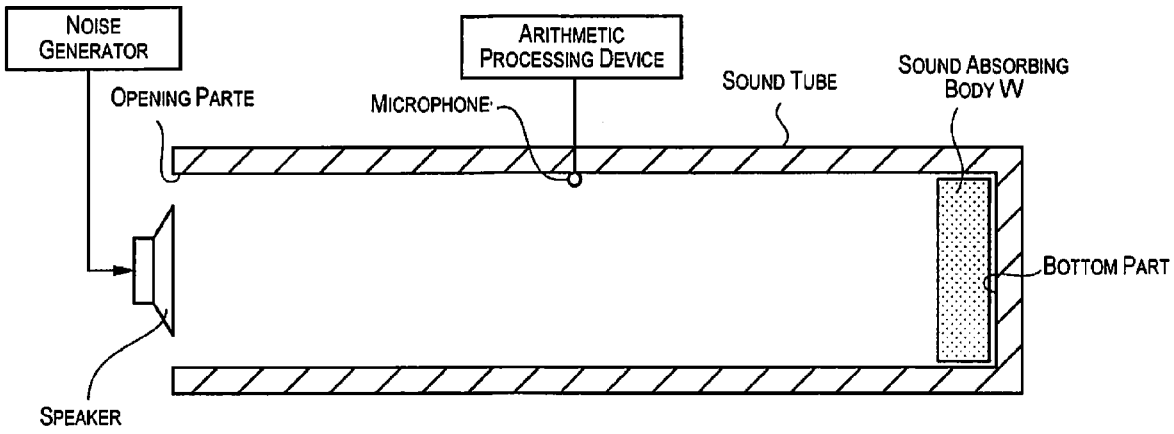
FIG. 4 is a pattern diagram showing the evaluation method of the sound absorbing properties of the sound absorbing body.

FIG. 4 is a pattern diagram showing the method for evaluating the sound absorption properties. As shown in FIG. 4, the equipment for evaluating the sound absorbing properties includes a sound tube, a bottom part provided at one end part of the sound tube, an opening part opened at the other end part of the sound tube, a microphone arranged inside the sound tube, a speaker arranged in the opening part of the sound tube, a noise generator connected to the speaker, and an arithmetic processing device and the like.

After the sound absorbing body W is set in the bottom part of the sound tube, sound of a designated frequency is radiated from the speaker, and a sound field is generated inside the sound tube. Then, the normal incident sound absorption rate is calculated based on the sound pressure signal obtained from the microphone inside the sound tube. By this evaluation, it is possible to evaluate the sound absorbing effect of the sound absorbing body W.

(b) Radiated Sound Frequency (b-1) 1000 Hz
(b-2) 2000 Hz
(b-3) 4000 Hz

Sound absorption was evaluated respectively for example 1 and comparison example 1, and for example 2 and comparison example 2 noted above. Table 1 shows the evaluation results for example 1 and comparison example 1, and table 2 shows the evaluation results for example 2 and comparison example 2. With table 1 and table 2, the sound absorption rate for each frequency of example 1 and example 2 is expressed when the sound absorption rate of the comparison example 1 and comparison example 2 is set as 1. Therefore, when the number is higher than the sound absorption rate 1 with the comparison example 1 and the comparison example 2, the evaluation is that there is a greater sound absorption effect. Meanwhile, when the number is smaller than the absorption rate 1 with the comparison example 1 and the comparison example 2, the evaluation is that there is a low sound absorption effect.

TABLE 1

| | 1000 Hz | 2000 Hz | 4000 Hz |
|---|---|---|---|
| Example 1 | 1.21 | 1.15 | 1.04 |
| Comparison Example 1 | 1 | 1 | 1 |

As shown in table 1, with example 1, the sound absorption rate for all frequency areas is a numerical value greater than the absorption rate with the comparison example 1, and the effect was of having excellent sound absorbing properties. This is because the sound absorbing body A of example 1 has a dense part and a non-dense part, and furthermore, by the non-dense part having a fibrillated part and an unfibrillated part, the sound absorbing effect is higher than with the comparison example 1.

TABLE 2

| | 1000 Hz | 2000 Hz | 4000 Hz |
|---|---|---|---|
| Example 2 | 1.26 | 1.18 | 1.09 |
| Comparison Example 2 | 1 | 1 | 1 |

As shown in table 2, with example 2, the sound absorption rate for all frequency areas is a numerical value greater than the absorption rate with the comparison example 2, and the effect was of having excellent sound absorbing properties. This is because the sound absorbing body B of example 2 has a dense part and a non-dense part, and the plurality of dense parts are laminated so as to gradually increase in density, and furthermore, by the non-dense part having a fibrillated part and an unfibrillated part, the sound absorbing effect is higher than with the comparison example 2.

The fibrillated part and the unfibrillated part which are the feature points of this application have paper pieces mixed in a fiber agglomeration having air gaps, and this can be understood visually by the external appearance. When the paper pieces are not exposed at the surface, this can be understood by cutting the sound absorbing body into a plurality of pieces, and by the paper pieces being exposed at the cut surface. Also, the non-dense parts and dense parts which are another feature point of this invention can also sometimes be understood visually by the external appearance or using a stereo microscope, but there are also cases when this cannot be understood. As a verification method in such a case, when a liquid with color added such as ink and the like is dripped, the speed of the ink infiltration differs between the non-dense parts and the dense parts. When the overall sound absorbing body has uniform density, the speed of the ink infiltration does not change according to the location at which the ink is dropped.

With the embodiments noted above, to prevent fuzz on the surface of the sound absorbing body 200 and 200*a* and the like, it is possible to adhere a thin non-woven cloth to the surface. Since adhered non-woven cloth is thinner than the sound absorbing body 200 and 200*a*, there is little effect on the sound absorbing properties.

With the embodiments noted above, the sound absorbing body 200 and 200*a* were a rectangular solid, but the invention is not limited to this. It is also possible to have a notch or recess in a portion of the rectangular solid, or to have a circular arc part or a sloped part rather than a rectangular solid.

With the embodiments noted above, the thickness of the layers corresponding to the non-dense parts 260 and the thickness of the layers corresponding to the dense parts 270*a* to 270*e* were laminated to be the same approximate thickness, but the invention is not limited to this constitution. For example, it is also possible to make the layers corresponding to the dense parts 270*a* to 270*e* thinner than the thickness of the layers corresponding to the non-dense part 220. By making the layers corresponding to the dense parts 270*a* to 270*e* thinner, it is possible to ensure an easy entry path in the sound absorbing body 200*a*, and possible to increase the sound absorbing effect.

With the embodiments noted above, the pulp sheet includes wood pulp such as of conifer trees, broad leafed trees and the like, non-wood plant fibers such as of hemp, cotton, kenaf and the like, and used paper and the like.

With the embodiments noted above, cellulose fiber was the main constituent, but as long as it is a material that absorbs sound, and can be given density differences, this is not limited to cellulose fiber. It is also possible to use fiber with a raw material of a plastic such as polyurethane or polyethylene terephthalate (PET) and the like, or another fiber such as wool and the like.

The method for forming the sound absorbing body is not limited to the method noted with the embodiments noted above. As long as the features of this application can be presented, another manufacturing method such as a wet method and the like can also be used.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A printing device comprising:

a case;

a printing unit arranged inside the case; and a sound absorbing body arranged inside the case, the sound absorbing body having parts with different densities including a dense part with a higher density and a non-dense part with a lower density, and the non-dense part including a fibrillated part that is fibrillated into fiber form and is included in a fiber group into which a pulp sheet is defibrillated at a defibrillating machine, and an unfibrillated part that is not fibrillated into fiber form and is included in the fiber group.

2. The printing device according to claim 1, wherein the dense part and the non-dense part are formed as a one piece, unitary body.

3. The printing device according to claim 2, wherein the density of the sound absorbing body gradually changes from the dense part toward the non-dense part.

4. The printing device according to claim 1, wherein the dense part includes a plurality of dense layers and the non-dense part includes a plurality of non-dense layers with the dense layers and the non-dense layers being alternately laminated, and the density of the dense layers gradually increases along a laminated direction.

5. A sound absorbing body comprising:

parts of different densities including a dense part with a higher density, and a non-dense part with a lower density, the non-dense part including a fibrillated part that is fibrillated into fiber form and is included in a fiber group into which a pulp sheet is defibrillated at a defibrillating machine, and an unfibrillated part that is not fibrillated into fiber form and is included in the fiber group.

6. The sound absorbing body according to claim 1, wherein the unfibrillated part has a plurality of paper-shaped pieces.

7. The printing device according to claim 4, wherein a dimension of each of the dense layers in the laminated direction is equal to a dimension of each of the non-dense layers in the laminated direction.

* * * * *